US005085143A

United States Patent [19]

Becker

[11] Patent Number: 5,085,143

[45] Date of Patent: Feb. 4, 1992

[54] SHEET-SIZE MULTIPLE-ADJUSTMENT DRIVE FOR A SHEET-FED ROTARY PRINTING MACHINE

[75] Inventor: Willi Becker, Bammental, Fed. Rep. of Germany

[73] Assignee: Heidelberger Druckmaschinen AG, Heidelberg, Fed. Rep. of Germany

[21] Appl. No.: 542,424

[22] Filed: Jun. 22, 1990

[30] Foreign Application Priority Data

Jun. 24, 1989 [DE] Fed. Rep. of Germany ..... 3920821

[51] Int. Cl.[5] ..... B41F 5/02

[52] U.S. Cl. ..... 101/183; 101/410

[58] Field of Search ..... 101/410, 409, 183, 230, 101/231, 232, 246, 184

[56] References Cited

U.S. PATENT DOCUMENTS

| | | | |
|---|---|---|---|
| 3,007,406 | 11/1961 | Papa et al. | 101/183 |
| 3,772,990 | 11/1973 | Weisgerber | 101/230 |
| 4,014,261 | 3/1977 | Becker | 101/230 |
| 4,122,773 | 10/1978 | Wirz | 101/410 X |
| 4,735,141 | 4/1988 | Becker | 101/410 X |

FOREIGN PATENT DOCUMENTS

| | | |
|---|---|---|
| 2139503 | 3/1972 | Fed. Rep. of Germany . |
| 2750105 | 5/1979 | Fed. Rep. of Germany . |
| 3736168 | 9/1988 | Fed. Rep. of Germany . |
| 73044 | 5/1970 | German Democratic Rep. . |
| 317526 | 8/1929 | United Kingdom . |

*Primary Examiner*—Clifford D. Crowder

*Attorney, Agent, or Firm*—Herbert L. Lerner; Laurence A. Greenberg

[57] ABSTRACT

A device for adjusting elements which are adjustable in dependence upon sheet size for gripping and guiding sheets in a sheet-fed rotary printing machine, wherein the adjustable elements are connected to drivable actuating members, comprising a common actuating-drive unit to which the actuating members of a plurality of the adjustable elements are connectible.

12 Claims, 5 Drawing Sheets

SHEET-SIZE MULTIPLE-ADJUSTMENT DRIVE FOR A SHEET-FED ROTARY PRINTING MACHINE

The invention relates to a device for adjusting elements which are adjustable in dependence upon sheet size elements for gripping and guiding sheets in a sheet-fed rotary printing machine, wherein the adjustable elements are connected to drivable actuating members.

German Published Non-Prosecuted Application (DE-OS) 27 50 105 describes a device for adjusting stops for a pile of sheets in a sheet feeder and in a sheet delivery in a sheet-processing machine transversely to the sheet travel direction in order to adapt to different format widths of the sheets. It has become known therefrom, individually, by means of an electronically controllable positioning apparatus with a pneumatically, hydraulically or electronically operated servo-motor, to arrange the adjustable stops movably on a guide element and to adjust them steplessly into a correct, format dependent position. The electronic control of the heretofore known device is programmable, with the result that, when there is a changeover of sheet size or format, all stops are automatically adjusted in the positions thereof to the newly set format or sheet size, the individual changeover being maintained, however, at each of the stops to be adjusted and it being yet necessary, however, to check the effected changeover at all stops. According to the text of the publication, a similar adjustment is supposed to be possible also in the sheet-travel direction, but the publication does not indicate how this is to be achieved technically. The heretofore known device achieves a reduction in set-up times when there is a changeover of format or sheet size, because stop adjustments transversely to the sheet-travel direction can be triggered by a common control command. In addition to these stop adjustments, however, it is necessary, when there is a changeover of format or sheet size, also to make change-overs in the sheet-travel direction and in circumferential direction on revolving sheet-guide drums, particularly on suction devices, sheet-support elements, gripping devices and sheet-conducting elements on the sheet-guide drums, as well as suction- and blowing devices in the sheet feeder and in the sheet delivery.

It is accordingly an object of the invention, therefore, to achieve a further reduction in the set-up times incurred when there is an adjustment of format or sheet size, by providing a device wherein a plurality of adjustment operations are effected compulsorily and in mutual dependance by a common actuating-drive unit, and wherein incorrect settings are thereby excluded so that a single safety check is sufficient for all compulsorily or forcibly effected changeovers. With the foregoing and other objects in view, there is provided, in accordance with the invention, a device for adjusting elements which are adjustable in dependence upon sheet size for gripping and guiding sheets in a sheet-fed rotary printing machine, wherein the adjustable elements are connected to drivable actuating members, comprising a common actuating-drive unit to which the actuating members of a plurality of the adjustable elements are connectible.

This makes it possible for all elements that are adjustable, when there is a changeover of sheet size or format, to be connected to a common or central actuating-drive unit, so that, when the sheet size is changed over, all adjustment operations are performed in compulsory or forcible dependence upon one another by the actuation of the central actuating-drive unit. The motion of the central actuating-drive unit can be effected either manually in accordance with a scale or, for example, by a servo-motor adjustable to the new format or sheet size.

Preferably drive chains, but also toothed belts, gearwheels, shaft transmissions, cam transmissions, lever mechanisms or transmissions or the like, are suitable for connecting the central or common actuating-drive unit to the adjustable elements on the sheet-guiding drums between two or more successive printing units and, if applicable, also in the sheet feeder as well as in the sheet delivery. For the use of drive chains, toothed belts or the like, it is advantageous, in accordance with the invention to mount, in the sheet-guide drums, in the sheet feeder and in the sheet delivery, rotatable actuating shafts having a rotary motion which causes an adjustment of the adjustable elements, for example, suction devices, sheet-support elements, gripping devices, sheet-conducting elements, suction and blowing-air devices, pile stops or the like. These actuating shafts are extended out of the machine at one end thereof, so that they are connectible to the output shaft of the common actuating-drive unit by means of one or more endlessly revolving driving members. The construction of the invention calls for each printing unit or a plurality of printing units together as well as the sheet feeder and the sheet delivery to be equipped with an actuating-drive member, and that all actuating-drive members be connectible to the central actuatingdrive unit. It is possible, in this connection, in accordance with the invention, to transmit the rotary motion of the central actuating-drive unit with different transmission ratios to the actuating members, firstly, in the printing units and, secondly, in the sheet feeder as well as in the sheet delivery.

In accordance with a further feature of the invention, an output gear of a gear unit of the central actuating-drive unit is connected by means of an endlessly guided traction member, for example a chain, to the actuating shafts of the adjusting devices of identical components of successive printing units of a sheet-fed rotary printing machine. In this case, a chain, which is fitted on an output gear of the gear unit of the central actuating-drive unit, connects, for example, all actuating shafts of the sheet-size adjusting device in the sheet-guide drums between successive printing units; a chain, fitted on another output gear of the gear unit of the central actuating-drive unit, connects, with different transmission ratios, the actuating shafts of the sheet-size adjusting apparatuses in the sheet feeder and in the sheet delivery.

In accordance with an added feature of the invention, the adjustable elements are movable by means of rotatably mounted actuating shafts, the actuating shafts extending out of the printing machine at one end thereof and being connectible by means of an endlessly revolving driving member to the common actuating-drive unit.

In accordance with an additional feature of the invention, the actuating shafts of the adjustable elements of a plurality of consecutive printing units of the printing machine, and actuating members of a sheet feeder as well as of a sheet delivery of the printing machine are connectible to the actuating-drive unit.

In accordance with again another feature of the invention, the actuating drive unit comprises a gear transmission with a plurality of output gears and has a variable transmission for transmitting actuating motion the output gears to the actuating members.

In accordance with again a further feature of the invention, there is provided rotatably mounted actuating shafts for moving the adjustable elements, and wherein one of the output gears of the gear transmission of the actuating-drive unit is connected by means of an endlessly guided tension member to the actuating shafts.

In accordance with again an added feature of the invention, the actuating-drive unit comprises a servo-motor and a speed-transforming gear unit connectible to one another, and a releasable coupling for releasing the speed-transforming gear unit.

In accordance with again an additional feature of the invention, the gear unit is a planetary transmission with a satellite carrier, the satellite carrier being lockable rigidly with the housing.

In accordance with yet another feature of the invention, in an unlocked condition of the satellite carrier and in a clamped condition of the actuating members the planetary gear unit serves as a free-wheeling mechanism for enabling rotation of the sheet-guiding drums.

In accordance with yet a further feature of the invention, the printing machine comprises a plurality of printing units with a plurality of transfer drums, and wherein the planetary transmission includes a central gear mounted on a shaft of the servo-motor, and an outer crown gear formed with internal toothing of a chain sprocket, the chain sprocket meshing with an endlessly guided chain, the chain being in meshing engagement and connecting respective chain sprockets or actuating shafts for adjustable elements on the transfer drums.

In accordance with yet an added feature of the invention, there is provided a plurality of chain sprockets juxtaposed on the shaft of the servo-motor and a plurality of chains meshing, respectively, with the chain sprockets and joining together a plurality of the actuating shafts.

In accordance with yet an additional feature of the invention, there is provided a plurality of separate, endlessly guided drive chains for connecting actuating shafts for adjusting sheet-guiding elements in a sheet feeder and in a sheet delivery of the printing machine, wherein the sheet-guiding elements are adjustable in dependence upon sheet size, to a transmission of the actuating-drive unit.

In accordance with still another feature of the invention, the transfer drums are rotatable in different rotational directions, extend in different directions over chain sprockets on the actuating shafts of the transfer drums in accordance with the respective directions of rotation of the transfer drums.

In accordance with still a further feature of the invention, the printing machine comprises a plurality of printing units with a plurality of transfer drums, and wherein the planetary transmission includes a central gear mounted on a shaft of the servo-motor, and an outer crown formed with internal toothing of a sprocket wheel, the sprocket wheel meshing with an endless toothed belt, the belt being in meshing engagement and connecting respective sprocket wheels on actuating shafts for adjustable elements on the transfer drums.

In accordance with still an added feature of the invention, the printing machine comprises a plurality of printing units with a plurality of transfer drums, and wherein the planetary transmission is connected to a transmission selected from the group consisting of gear transmissions, shaft transmissions, cam transmissions and lever transmissions for connecting respective actuating shafts for adjustable elements on the transfer drums.

In accordance with still an additional feature of the invention, the adjustable elements are disposed one behind the other.

In accordance with a further feature of the invention, the adjustable elements are disposed one behind the other in travel direction of sheets through the printing machine.

In accordance with a concomitant feature of the invention, the adjustable elements are disposed transversely to sheet travel direction through the printing machine.

Other features which are considered as characteristic for the invention are set forth in the appended claims.

Although the invention is illustrated and described herein as embodied in a sheet-size multiple-adjustment drive for a sheet-fed rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
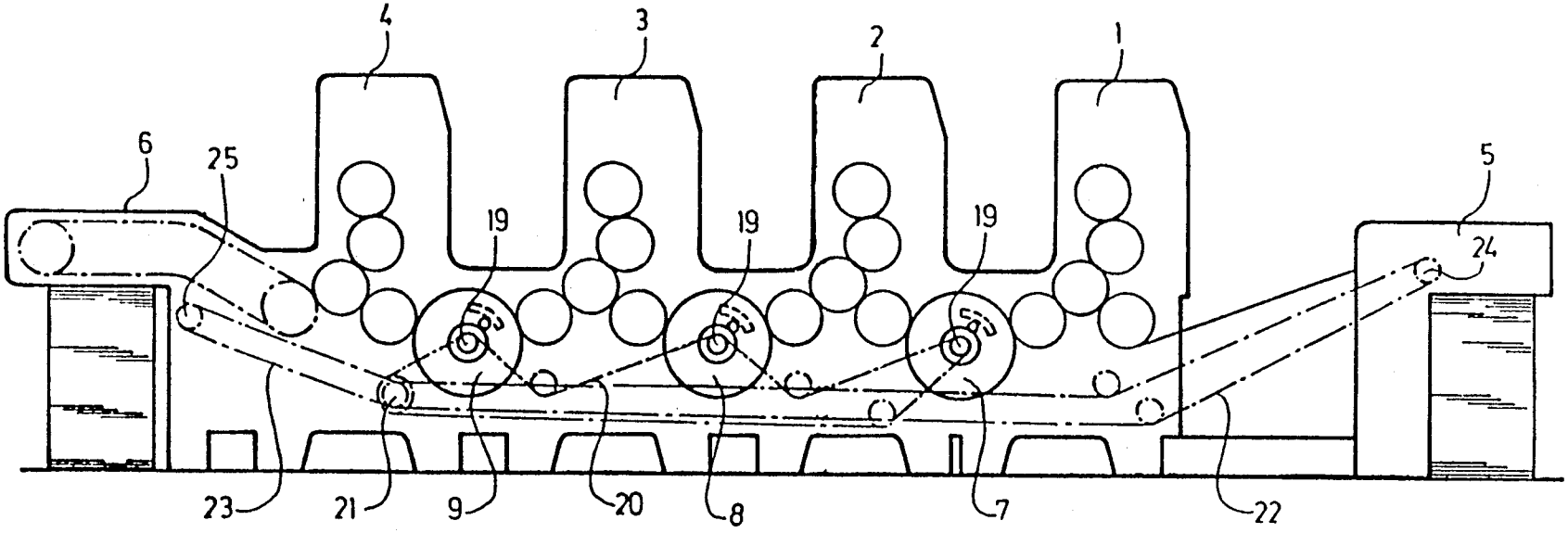
FIG. 1 is a diagrammatic side elevational view of a sheet-fed rotary printing machine incorporating the sheet-size multiple-adjustment drive according to the invention.

Referring now to the drawing and, first, particularly to FIG. 1 thereof, there is shown therein a sheet-fed rotary printing machine according to an embodiment of the invention having four printing units 1, 2, 3 and 4, a sheet feeder 5 located upstream or in front of the first printing unit 1, in sheet-travel direction through the printing machine, and a sheet delivery 6 following the last printing unit 4. Between each preceding printing unit and each following printing unit, respectively, a sheet-guiding drum 7, 8 or 9 is located and accepts from a preceding printing unit a sheet, which has been lifted off a pile in the feeder 5 and fed to the first printing unit 1, and then feeds the sheet to the next following printing unit until the printed sheet reaches a pile at the delivery 6.

Figure 2:
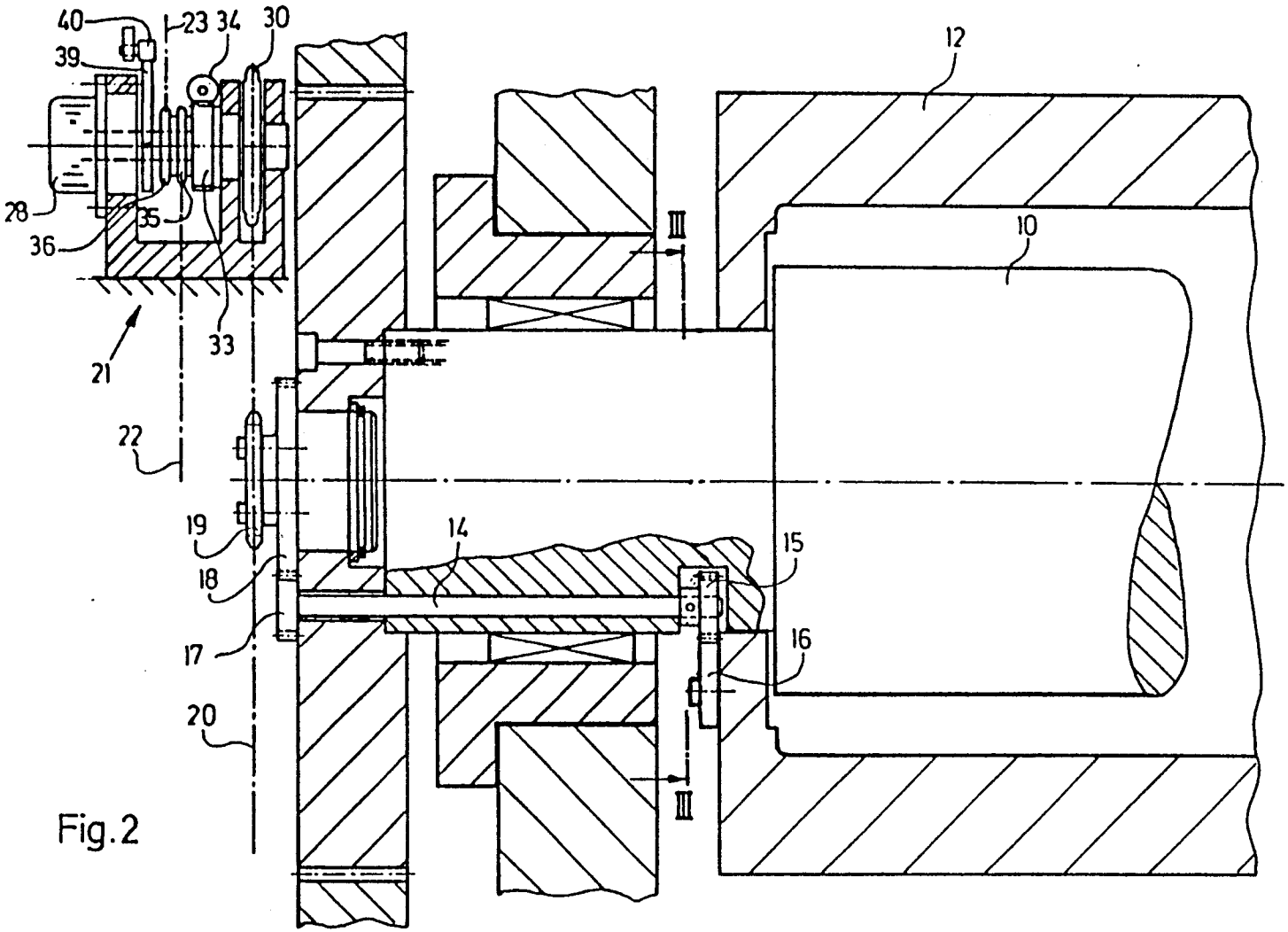
FIG. 2 is a much-enlarged, fragmentary cross-sectional view of FIG. 1 taken along an axial plane through one of the bearings of a sheet-guiding drum thereof.
Figure 3:
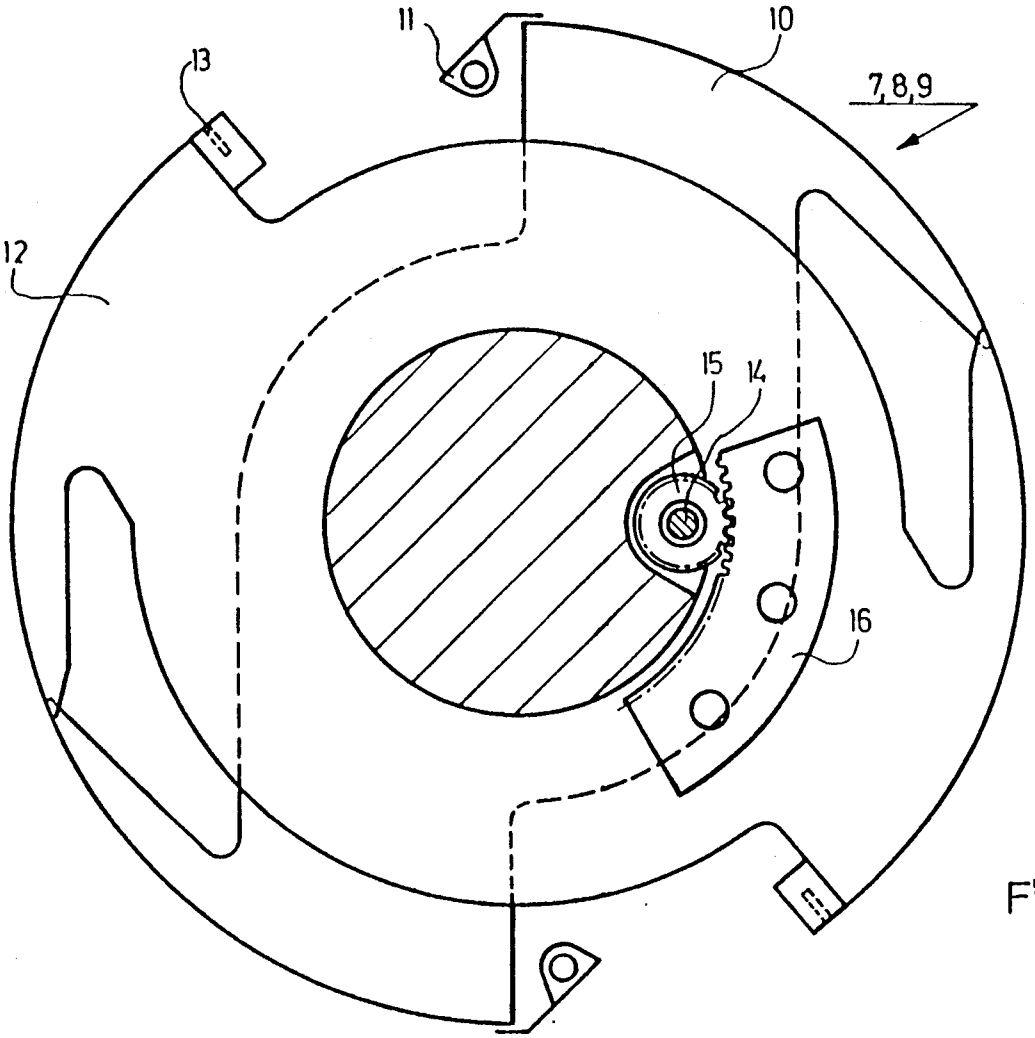
FIG. 3 is a sectional view of FIG. 2 taken along the line III—III in the direction of the arrows.

Sheet-size or format adjustment is represented in FIG. 3 with reference to the example of a sheet-guiding drum 7, 8, 9. A movable drum part 12 is adjustable in circumferential direction with respect to a fixed drum part 10 on which sheet grippers 11 are mounted. Disposed on the movable drum part 12 are, for example, suction nozzles 13 which must be adjusted in sheet travel direction, for every sheet-size or format adjustment which involves an adjustment of the sheet length. To effect this adjustment in circumferential direction, there is mounted in the sheet-guiding drum, eccentrically but axially parallel to the rotational axis of the sheet-guiding drum, an actuating shaft 14 having an inner end to which a gearwheel 15 is attached. The gearwheel 15 is formed with teeth, in meshing engagement with inner teeth of a toothed segment 16 mounted on the movable drum part 12 The other end of the actuating shaft 14 extends out of the sheet-guiding drum at the end face thereof and likewise carries a gearwheel 17 formed with teeth which are in meshing engagement with teeth of a gearwheel 18 mounted coaxially with the rotational axis of the sheet-guiding drum. Connected to the gearwheel 18, in the embodiment of FIG. 2, is a chain sprocket 19, which is connectible to a central actuating-drive unit through an endlessly revolving chain 20, a toothed belt or equivalent transmission members. The actuating members in the other sheet-guiding drums and also in the sheet feeder and in the sheet delivery may be of identical construction. After the changeover, the fixed drum part 10 and the movable drum part 12 are clamped together in a conventional manner. After this clamping is released, the movable parts are repositionable with respect to the fixed parts by rotation of the actuating shaft 14. This repositioning when the clamping is released is effected by a centrally disposed actuating-drive unit 21, which may be located at any point in the machine. From the central actuating-drive unit 21, which is operable manually or is equipped with a servo-motor, the actuating motion is transmitted by means of the chain 20 or a plurality of chains 22 and 23 to the chain sprocket 19 on the sheet-guiding drums 7, 8 and 9 and to chain sprockets 24 and 25 of actuating members in the sheet feeder 5 and in the sheet delivery 6, respectively.

Figure 5:
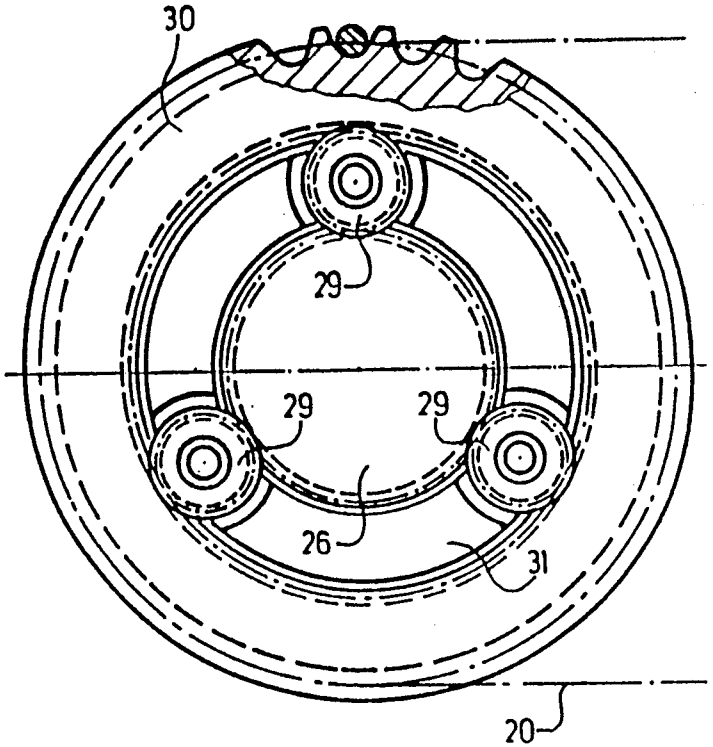
FIG. 5 is a side elevational view of a planetary transmission in the actuating-drive unit shown in FIG. 4.
Figure 4:
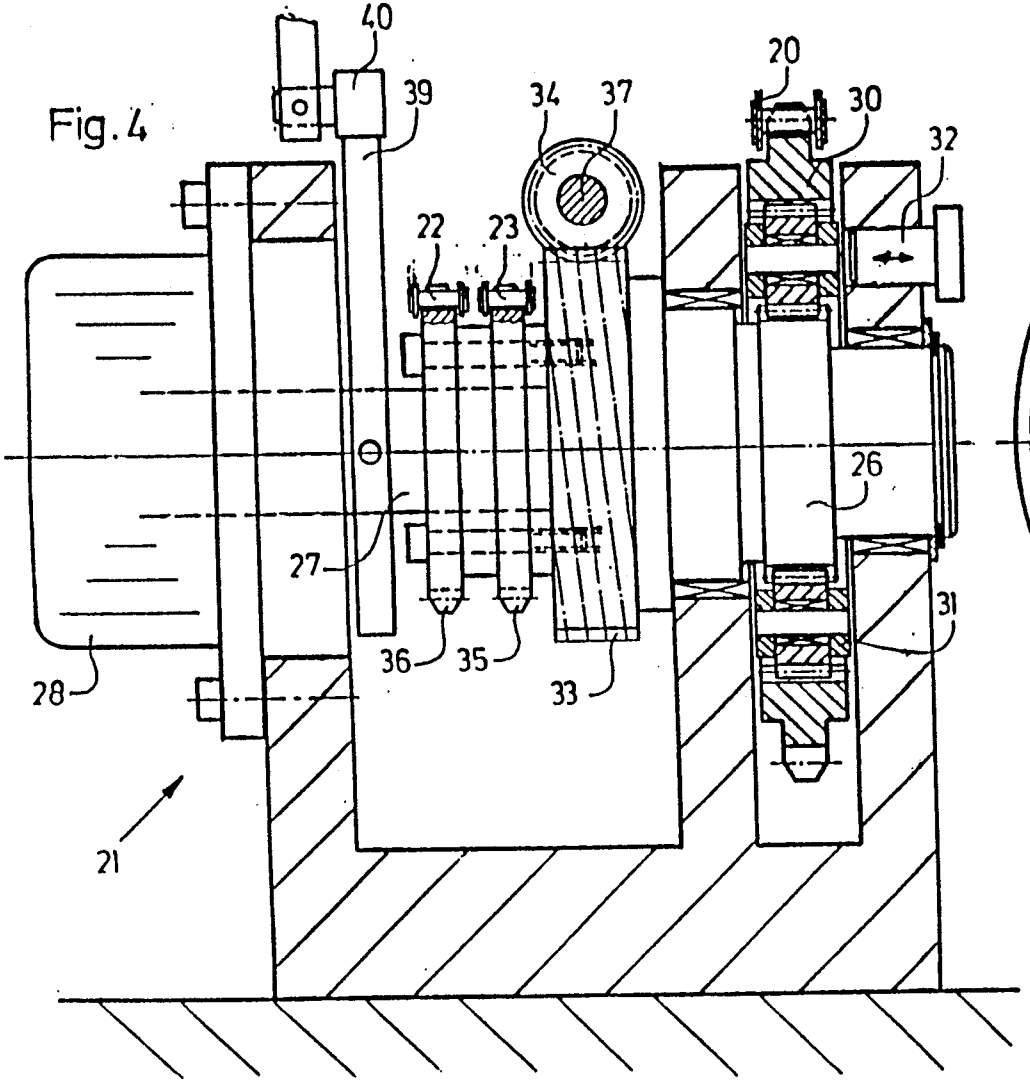
FIG. 4 is an enlarged fragmentary view of FIG. 2 in greater detail of a central actuating-drive unit with transmission; located at the upper left-hand side of FIG. 2.

Because the gearwheels 19 on the sheet-guiding drums 7, 8 and 9 revolve together with those drums, the chain 20 also revolves during the operation. For this reason, a free-wheeling mechanism is necessary in the central actuating-drive unit 21, the free-wheeling mechanism, in the embodiment of FIG. 2, being in the form of a planetary transmission or gear unit as shown in FIGS. 4 and 5. A central gear 26 of the planetary transmission or gear unit is mounted in the form of a crown gear on a shaft 27 of a motorized drive unit 28. Planet gears 29, which engage the teeth of the central gear 26, also engage inner teeth of a chain sprocket 30, which forms the outer gear of the planetary gear unit. The chain sprockets 19 are connected to the chain sprocket 30 by the chain 20. A planet-gear or satellite carrier 31 can be locked so as to be rigid with the housing by means of a locking bar or safety bolt 32. During the operation of the printing machine, the satellite carrier 31 is released, so that the planetary gear unit acts as a free-wheeling mechanism, because the planet gears are able to roll freely in the teeth of the central gear and also in the teeth of the outer gear without transmitting any torque. For the purpose of changing over the sheet size or format, the clamping effected between the fixed drum part 10 and the movable drum part 12 is released. At the same time, the satellite carrier 31 is locked rigid with the housing by means of the locking bar 32. It is then possible, by means of the central actuating-drive unit, to transmit actuating force from the central gear 26 via the planet gears 29, the planet carrier 31 of which is locked, to the chain sprocket 30 and thus via the chain 20 to the chain sprockets 19 of the sheet-guiding drums 7, 8 and 9. After the changeover of sheet size, a renewed clamping of the movable drum part 12 to the fixed drum part 10 occurs and the locking bar 32 is released, so that the satellite carrier 31 is again able to revolve and the planetary gear unit acts as a free-wheeling mechanism during the operation of the printing machine.

Figure 6:
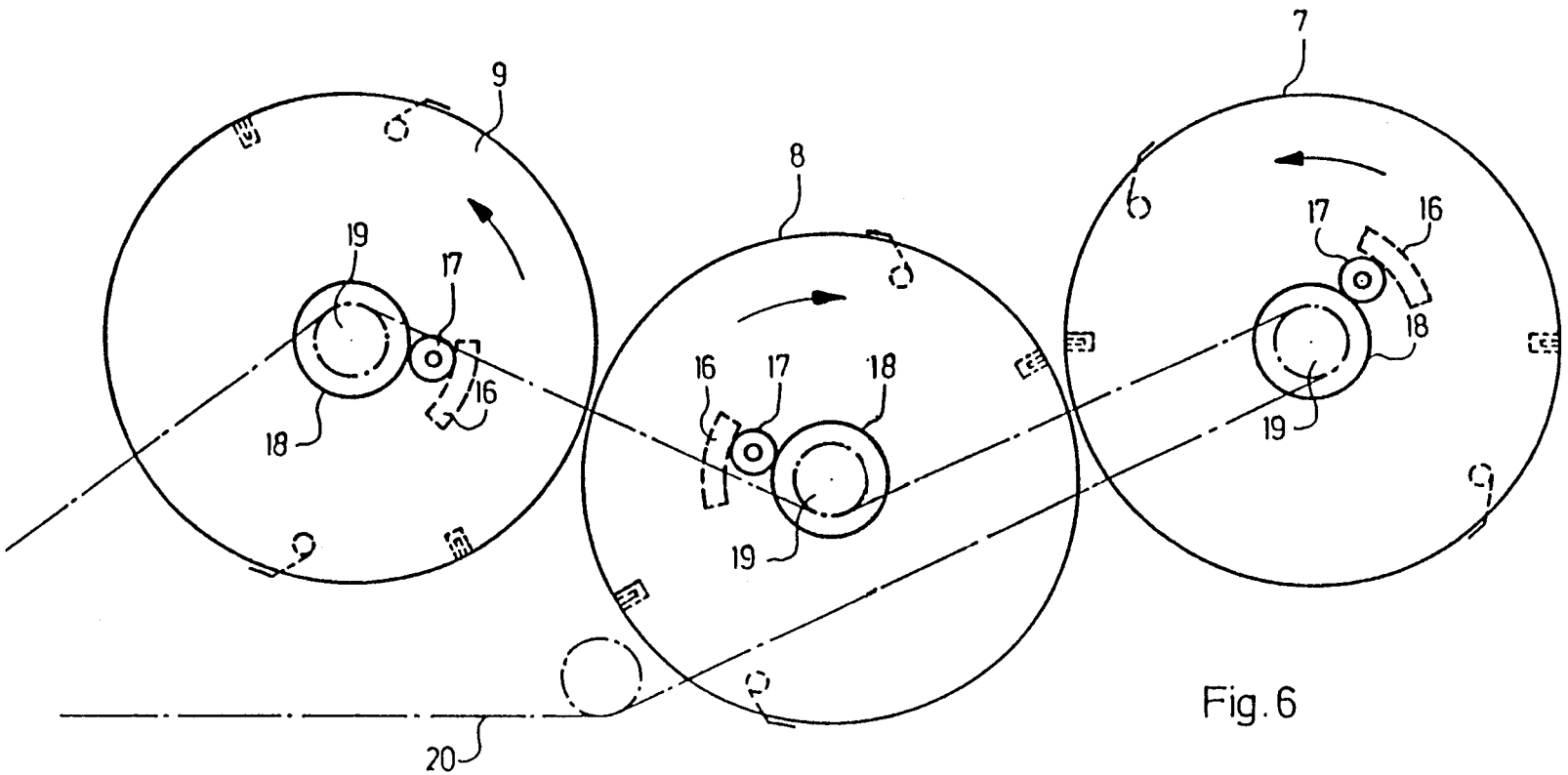
FIG. 6 is a diagrammatic view of oppositely rotating sheet-guide drums of a sheet-fed rotary printing machine and illustrating the routing of a chain for driving the drums.

From the shaft 27, it is also possible to transmit repositioning motions simultaneously in different transmission ratios to other actuating members, particularly to actuating members in the sheet feeder 5 and in the sheet delivery 6. Mounted for this purpose on the shaft 27 of the drive motor 28 is a worm 33, which engages a worm wheel 34 having a shaft 37 which transmits adjusting motions either directly to actuating members, for example in the sheet feeder or in the sheet delivery, or on which there is mounted a chain sprocket for transmitting the actuating motions by means of drive chains. For the transmission of other actuating motions, there are provided on the shaft 27 of the drive motor 28 of the central actuating-drive unit additional chain sprockets 35 and 36, by which it is possible for actuating motions of different transmission ratios, if necessary or desirable, to be transmitted to actuating members by means of the chains 22 and 23. Instead of the transmission of the actuating motion by means of chains as described with reference to the illustrated embodiment of FIG. 1, for example, it is possible for the transmission to be effected also by toothed belts, by gear transmissions, by shaft transmissions or also by lever mechanisms or transmissions. Shown by way of further example is the transmission of the actuating motions of the shaft 27 by means of a cam transmission formed of a cam disc 39 mounted on the shaft 27 and contacted by a cam roller 40, so that radial movements of the cam roller 40 with respect to the rotational axis of the shaft 27 are transmissible as actuating motions to actuating members. If use is made of endlessly revolving transmission members, for example, chains, the different directions of rotation of the sheet-guiding drums and, thus, of the co-revolving chain sprockets 19 must be taken into consideration in that the chain 20, when adjustment is made to the respective direction of rotation, must be fitted on the teeth of the chain sprockets 19 alternately from above and from below, as is illustrated by way of example in FIG. 6.

I claim:

1. Device for adjusting elements which are adjustable in dependence upon sheet size for gripping and guiding sheets in a sheet-fed rotary printing machine, wherein the adjustable elements are connected to driveable actuating members, comprising a common actuating-drive unit to which the actuating members of a plurality of the adjustable elements are connectible, the adjustable elements being movable by means of rotatably mounted actuating shafts, said actuating shafts extending out of the printing machine at one end thereof and being connectible by means of an endlessly revolving driving member to said common actuation-drive unit, said actuating shafts of the adjustable elements of a plurality of consecutive printing units of the printing machine, and actuating members of a sheet feeder as well as of a sheet delivery of the printing machine being connectible to said actuating-drive unit, said actuating drive unit comprising a gear transmission with a plurality of output gears and a variable transmission for transmitting actuating motion from said output gears to the actuating members, said actuating-drive unit comprising a servomotor and a speed-transforming gear unit connectible to one another, and a releasable coupling for releasing said speed-transforming gear unit.

2. Device according to claim 1, including rotatably mounted actuating shafts for moving the adjustable elements, and wherein one of said output gears of said gear transmission of said actuating-drive unit is connected by means of an endlessly guided tension member to said actuating shafts.

3. Device according to claim 1, including a plurality of separate, endlessly guided drive chains for connecting actuating shafts for adjusting sheet-guiding elements in a sheet feeder and in a sheet delivery of the printing machine, wherein the sheet-guiding elements are adjustable in dependence upon sheet size, to a transmission of said actuating-drive unit.

4. Device according to claim 1, wherein said adjustable elements are disposed in succession in travel direction of sheets through the printing machine.

5. Device according to claim 1, wherein said adjustable elements are disposed transversely to sheet travel direction through the printing machine.

6. Device for adjusting elements which are adjustable in dependence upon sheet size for gripping and guiding sheets in a sheet-fed rotary printing machine, wherein the adjustable elements are connected to drivable actuating members, comprising a common actuating-drive unit to which the actuating members of a plurality of the adjustable elements are connectible, said actuating-drive unit comprising a servo-motor and a speed-transforming gear unit connectible to one another, and a releasable coupling for releasing said speed-transforming gear unit, said gear unit being received in a housing and being a planetary transmission with a satellite carrier, said satellite carrier being lockable rigidly with the housing.

7. Device according to claim 6, wherein, in an unlocked condition of said satellite carrier and in a clamped condition of said actuating members said planetary gear unit serves as a free-wheeling mechanism for enabling rotation of the sheet-guiding drums.

8. Device according to claim 6, wherein the printing machine comprises a plurality of printing units with a plurality of transfer drums, and wherein said planetary transmission includes a central gear mounted on a shaft of said servomotor, and an outer crown gear formed with internal toothing of a chain sprocket, said chain sprocket meshing with an endlessly guided chain, said chain being in meshing engagement and connecting respective chain sprockets or actuating shafts for adjustable elements on the transfer drums.

9. Device according to claim 8, including a plurality of chain sprockets juxtaposed on said shaft of said servo-motor and a plurality of chains meshing, respectively, with said chain sprockets and joining together a plurality of said actuating shafts.

10. Device according to claim 9, wherein the transfer drums are rotatable in different rotational directions, extend in different directions over chain sprockets on said actuating shafts of the transfer drums in accordance with the respective directions of rotation of the transfer drums.

11. Device according to claim 6, wherein said printing machine comprises a plurality of printing units with a plurality of transfer drums, and wherein said planetary transmission includes a central gear mounted on a shaft of said servo-motor, and an outer crown formed with internal toothing of a sprocket wheel, said sprocket wheel meshing with an endless toothed belt, said belt being in meshing engagement and connecting respective sprocket wheels on actuating shafts for adjustable elements on the transfer drums.

12. Device according to claim 6, wherein said printing machine comprises a plurality of printing units with a plurality of transfer drums, and wherein said planetary transmission is connected to a transmission selected from the group consisting of gear transmissions, shaft transmissions, cam transmissions and lever transmissions for connecting respective actuating shafts for adjustable elements on the transfer drums.

* * * * *